US007997883B2

(12) United States Patent
Ignatiev

(10) Patent No.: US 7,997,883 B2
(45) Date of Patent: Aug. 16, 2011

(54) SCROLL COMPRESSOR WITH SCROLL DEFLECTION COMPENSATION

(75) Inventor: Kirill Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 303 days.

(21) Appl. No.: 12/053,118

(22) Filed: Mar. 21, 2008

(65) Prior Publication Data

US 2009/0098000 A1 Apr. 16, 2009

Related U.S. Application Data

(60) Provisional application No. 60/979,543, filed on Oct. 12, 2007.

(51) Int. Cl.
*F03C 2/00* (2006.01)
*F03C 4/00* (2006.01)
*F04C 18/00* (2006.01)

(52) U.S. Cl. ..... 418/55.2; 418/15; 418/55.5; 418/57; 418/179

(58) Field of Classification Search ..... 418/15, 418/55.1–55.5, 57, 179, 178
See application file for complete search history.

(56) References Cited

U.S. PATENT DOCUMENTS

| | | | | |
|---|---|---|---|---|
| 4,365,941 | A | 12/1982 | Tojo et al. | |
| 4,600,369 | A | 7/1986 | Blain | |
| 4,714,415 | A * | 12/1987 | Mizuno et al. | 418/14 |
| 4,993,928 | A | 2/1991 | Fraser, Jr. | |
| 5,040,956 | A | 8/1991 | Barito et al. | |
| 5,085,565 | A * | 2/1992 | Barito | 418/55.5 |
| 5,090,878 | A | 2/1992 | Haller | |
| 5,125,810 | A * | 6/1992 | Suefuji et al. | 418/55.2 |
| 5,145,345 | A | 9/1992 | Barito et al. | |
| 5,256,044 | A | 10/1993 | Nieter et al. | |
| 5,277,563 | A | 1/1994 | Wen-Jen et al. | |
| 5,462,419 | A | 10/1995 | Hill et al. | |
| 5,741,120 | A | 4/1998 | Bass et al. | |
| 5,762,483 | A * | 6/1998 | Lifson et al. | 418/55.5 |
| 5,829,959 | A * | 11/1998 | Tsubono et al. | 418/55.5 |
| 6,168,404 | B1 | 1/2001 | Gatecliff | |
| 6,174,150 | B1 | 1/2001 | Tsubono et al. | |
| 6,514,060 | B1 | 2/2003 | Ishiguro et al. | |

(Continued)

FOREIGN PATENT DOCUMENTS

JP 05312156 11/1993

(Continued)

OTHER PUBLICATIONS

International Search Report regarding International Application No. PCT/US2008/011253 dated Mar. 30, 2009.

(Continued)

*Primary Examiner* — Thereas Trieu
(74) *Attorney, Agent, or Firm* — Harness, Dickey & Pierce, P.L.C.

(57) ABSTRACT

A scroll compressor may incorporate controlled bending of a scroll member to compensate for axial deformations that can occur between the scroll members. The controlled bending may be through the use of fluid pressure in a sealed chamber that communicates with a surface of the scroll member opposite the intermeshing wraps. Fluid passageways can extend through the scroll member between the sealed chamber and the intermeshing wraps. The controlled bending can increase the uniformity of the contact between the scroll members and improve the efficiency of the compressing operation.

20 Claims, 4 Drawing Sheets

U.S. PATENT DOCUMENTS

| | | | |
|---|---|---|---|
| 6,554,592 | B1 | 4/2003 | Sun et al. |
| 6,695,599 | B2 | 2/2004 | Uchida et al. |
| 6,719,545 | B2 | 4/2004 | Iizuka |
| 6,896,497 | B2 | 5/2005 | Kuo |
| 6,984,115 | B1 | 1/2006 | Tarng et al. |
| 7,014,434 | B2 | 3/2006 | Fujioka et al. |
| 7,140,851 | B2 | 11/2006 | Tarng |
| 2002/0039540 | A1 | 4/2002 | Kuroki et al. |
| 2004/0081562 | A1 | 4/2004 | Seibel et al. |
| 2005/0226755 | A1 | 10/2005 | Tsuchiya et al. |
| 2005/0265880 | A1 | 12/2005 | Chang et al. |
| 2006/0051227 | A1 | 3/2006 | Tarng |
| 2006/0057010 | A1 | 3/2006 | Tsubono et al. |

FOREIGN PATENT DOCUMENTS

| | | | | |
|---|---|---|---|---|
| JP | 11264386 | A | * | 9/1999 |
| KR | 1019980070887 | | | 10/1998 |
| KR | 1020030012662 | | | 2/2003 |

OTHER PUBLICATIONS

Written Opinion of the International Searching Authority regarding International Application No. PCT/US2008/011253 dated Mar. 30, 2009.

International Preliminary Report on Patentability regarding International Application No. PCT/US2008/011253 dated Apr. 13, 2010.

* cited by examiner

SCROLL COMPRESSOR WITH SCROLL DEFLECTION COMPENSATION

CROSS-REFERENCE TO RELATED APPLICATIONS

This application claims the benefit of U.S. Provisional Application No. 60/979,543, filed on Oct. 12, 2007. The disclosure of the above application is incorporated herein by reference.

FIELD

The present teachings relate generally to scroll compressors and, more particularly, to scroll compressors with scroll deflection compensation.

BACKGROUND AND SUMMARY

The statements in this section merely provide background information related to the present teachings and may not constitute prior art.

A scroll compressor can compress a fluid from a suction pressure to a discharge pressure greater than the suction pressure. The scroll compressor can use a non-orbiting scroll member and an orbiting scroll member, each having wraps positioned in meshing engagement with one another. The relative movement between the scroll members causes the fluid pressure to increase as the fluid moves from the suction port to the discharge port. To improve efficiency, the orbiting and fixed scroll members are designed to be in a uniform, but light, contact with each other to maintain sealing therebetween.

During operation, however, the base plates of the fixed and orbiting scroll members can experience axial deformations due to high fluid pressure present in the compression chambers formed by the intermeshing wraps. The axial deformations can be more pronounced at locations corresponding to higher fluid pressure. Additionally, the wraps of both the fixed and orbiting scroll members may experience thermal growth due to contact with the hot compressed fluid in the compression chambers. The thermal growth can be more pronounced in locations corresponding to higher fluid temperature. The axial deformations and/or thermal growth may adversely impact the ability to maintain sealing between the scroll members.

A scroll compressor according to the present teachings may incorporate controlled bending of the fixed scroll member to compensate for the deformations during operation. The controlled bending may be achieved through the use of fluid pressure in a sealed chamber that communicates with the fixed scroll member. Fluid passageways can extend through the fixed scroll member between the sealed chamber and the intermeshing orbiting scroll member. The controlled bending can increase the uniformity of the contact between the scroll members and thereby improve the efficiency of the compressing operation. A method of operating a scroll compressor according to the present teachings can include the varying of the fluid pressure in a cavity on a non-intermeshed side of the non-orbiting scroll member to cause controlled bending of the non-orbiting scroll member and compensate for deformation to one or both of the scroll members due to compression of a working fluid.

Further areas of applicability will become apparent from the description provided herein. It should be understood that the description and specific examples are intended for purposes of illustration only and are not intended to limit the scope of the present claims.

DRAWINGS

The drawings described herein are for illustration purposes only and are not intended to limit the scope of the present teachings in any way.

DETAILED DESCRIPTION

The following description is merely exemplary in nature and is not intended to limit the present disclosure, application, or uses.

Figure 1:
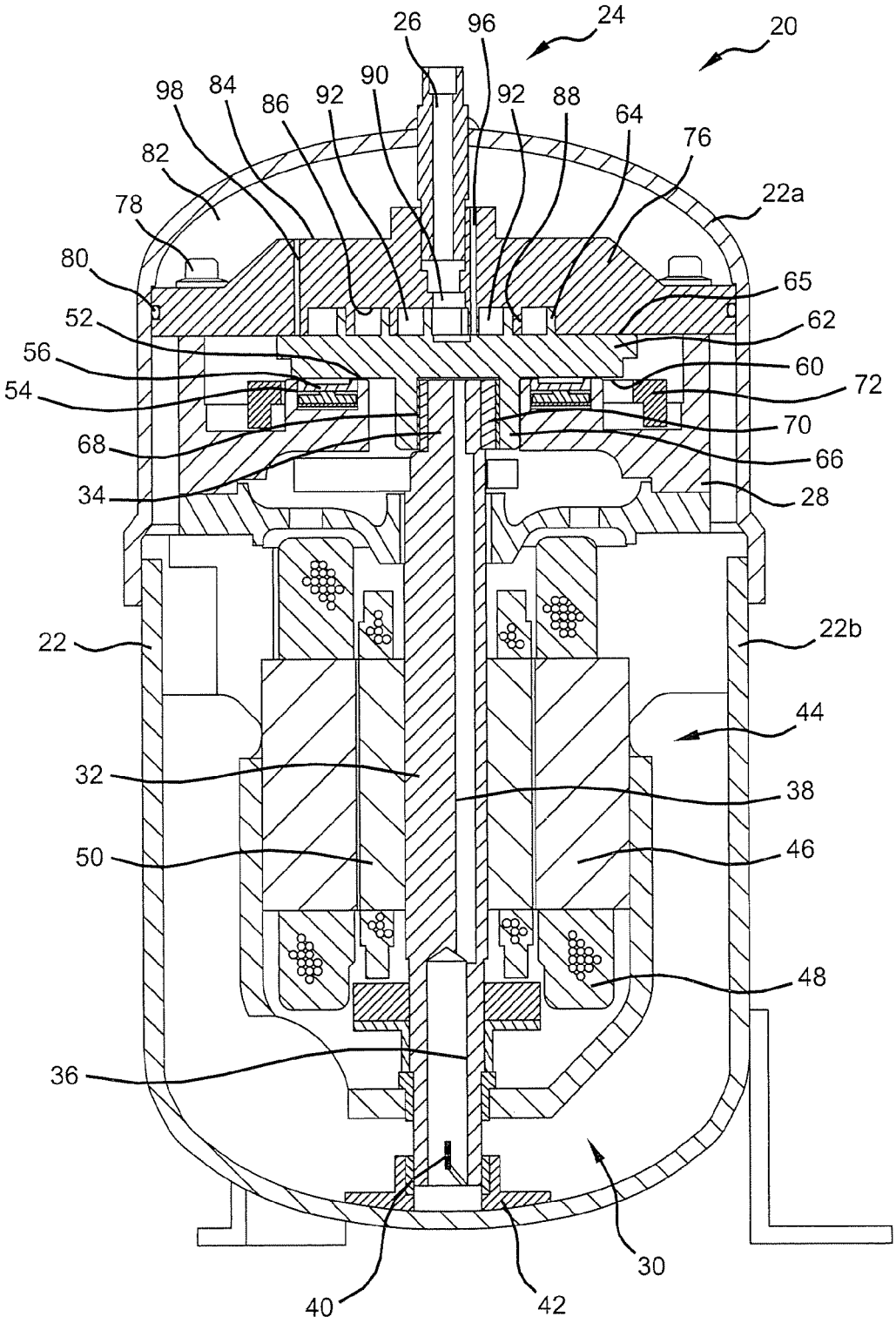
FIG. 1 is a cross-sectional view of a scroll compressor according to the present teachings.
Figure 2:
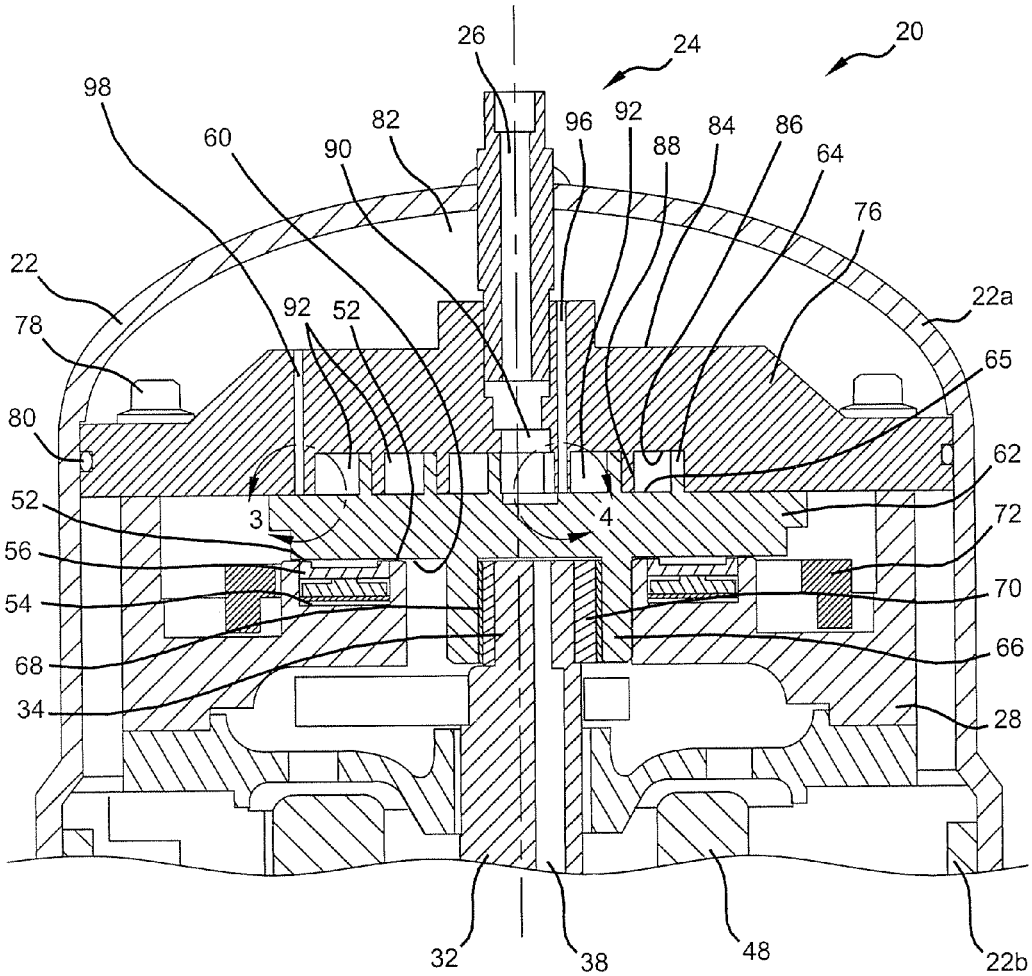
FIG. 2 is an enlarged fragmented view of a portion of the compressor of FIG. 1 showing details of the fixed and orbiting scroll members in a first position.

Referring to FIGS. 1 and 2, an exemplary scroll compressor 20 according to the present teachings is shown. Compressor 20 comprises a shell 22 having an upper portion 22*a* that is attached to a lower portion 22*b* in a sealed relationship. Shell 22 can be generally cylindrical. Upper shell 22*a* is provided with a refrigerant discharge port 24 through which a refrigerant discharge passage 26 extends. A stationary main bearing housing or body 28 and a lower bearing assembly 30 are secured in shell 22. A driveshaft or crankshaft 32 having an eccentric crankpin 34 at the upper end thereof is rotatably journaled in main bearing housing 28 and in lower bearing assembly 30. Crankshaft 32 has at the lower end a relatively large diameter concentric bore 36 which communicates with a radially outwardly inclined small diameter bore 38 extending upwardly therefrom to the top of crankshaft 32. Disposed within bore 36 is a stirrer 40. The lower portion of lower shell 22*b* forms a sump which is filled with lubricant and bore 36 can act as a pump to pump lubricating fluid up crankshaft 32 and into bore 38 and ultimately to various portions of the compressor that require lubrication. A strainer 42 is attached to the lower portion of shell 22*b* and directs the lubricant flow into bore 36.

Crankshaft 32 is rotatably driven by an electric motor 44 disposed within lower bearing assembly 30. Electric motor 44 includes a stator 46, windings 48 passing therethrough, and a rotor 50 rigidly mounted on crankshaft 32.

The upper surface of main bearing housing 28 includes a flat thrust-bearing surface 52 with an axially extending recess 54 therein. A floating seal 56 is disposed in recess 54. Thrust-bearing surface 52 and floating seal 56 axially support a lower surface 60 of an orbiting scroll member 62. Orbiting scroll member 62 includes a spiral vane or wrap 64 extending axially upwardly from an upper surface 65 thereof. Projecting downwardly from lower surface 60 of orbiting scroll member 62 is a cylindrical hub 66 having a journal bearing 68 and a drive bushing 70 therein and within which crankpin 34 is drivingly disposed. Crankpin 34 has a flat on one surface that drivingly engages a flat surface (not shown) formed in a portion of drive bushing 70 to provide a radially compliant drive arrangement, such as shown in Assignee's U.S. Pat. No. 4,877,382, entitled "Scroll-Type Machine with Axially Compliant Mounting," the disclosure of which is herein incorporated by reference. An Oldham coupling 72 can be positioned between and keyed to orbiting scroll member 62 and bearing housing 28 to prevent rotational movement of orbiting scroll member 62. Oldham coupling 72 may be of the type disclosed in the above-referenced U.S. Pat. No. 4,877,382; however, other Oldham couplings, such as the coupling disclosed in Assignee's U.S. Pat. No. 6,231,324, entitled "Oldham Coupling for Scroll Machine," the disclosure of which is hereby incorporated by reference, may also be used.

A non-orbiting scroll member 76 is stationarily secured within shell 22. Non-orbiting scroll member 76 can be secured to main bearing housing 28 with bolts 78. Main bearing housing 28 can provide axial support for the periphery of non-orbiting scroll member 76. A seal 80 can extend between upper shell 22*a* and the side of non-orbiting scroll member 76 to form a seal therebetween. A cavity 82 can be disposed above upper surface 84 of non-orbiting scroll member 76. Cavity 82 can be defined by upper surface 84 and upper shell 22*a*.

Non-orbiting scroll member 76 includes opposite upper and lower surfaces 84, 86. Lower surface 86 includes a spiral vane or wrap 88 that extends axially downwardly and is in meshing engagement with wrap 64 of orbiting scroll member 62. Non-orbiting scroll member 76 has a centrally disposed discharge passage/port 90 that communicates with discharge passage 26 to direct compressed fluid out of scroll compressor 20. A discharge valve (not shown) may be disposed in discharge passage 90 and/or discharge passage 26. The discharge valve can be a one-way valve. Discharge passage 26 is disposed in discharge port 90 in a sealed manner that prevents fluid flowing through discharge port 90 and discharge passageway 26 from communicating with fluid in cavity 82 and can allow some relative axial motion between discharge passage 26 and non-orbiting scroll member 76.

Orbiting scroll member 62 can orbit relative to non-orbiting scroll member 76 and cause the respective wraps 64, 88 to move relative to one another and form compression cavities/pockets 92 which progressively diminish in volume to compress the fluid therein. As best seen in FIG. 2, a plurality of compression cavities 92 is formed between wraps 64, 88. During operation, the fluid is sucked into the scroll set at a suction pressure adjacent the periphery of orbiting scroll member 62. The fluid is then compressed to the discharge pressure by the progressively diminishing size of compression cavities 92 and is discharged through discharge passage 90 in the center of non-orbiting scroll member 76. Because the pressure of the fluid being compressed within intermeshing wraps 64, 88 increases as the fluid advances toward the center of non-orbiting scroll member 76, the axial force from the compressed fluid is greatest adjacent discharge passage 90 and is lower adjacent the periphery of orbiting scroll member 62 wherein the fluid is at suction pressure.

As stated above, axial support for orbiting scroll member 62 is provided by floating seal 56 and thrust-bearing surface 52. Floating seal 56 and thrust-bearing surface 52, however, are located near the periphery of orbiting scroll member 62. As a result, orbiting scroll member 62 can experience bending such that upper surface 65 becomes concave (deformed downwardly in the view depicted in FIG. 2), especially near the center. Similarly, non-orbiting scroll member 76 is axially supported by bearing housing 28 adjacent the periphery and the higher pressure adjacent the center of non-orbiting scroll member 76 can cause lower surface 86 to also bend and become concave (deformed upwardly in the view depicted in FIG. 2). The deflection of the central portion of orbiting scroll member 62 (downward in the view depicted in FIG. 2) can be about 15-20 microns, relative to the periphery of orbiting scroll member 62, by way of non-limiting example. Similarly, the deflection of the central portion of fixed scroll member 76 can be about 10-15 microns (upwards in the view depicted in FIG. 2) relative to the periphery of fixed scroll member 76, by way of non-limiting example.

In addition to the axial-separating forces caused by the fluid pressure between intermeshing wraps 64, 88, the temperature of the compressed fluid also increases from the periphery toward the center of non-orbiting scroll member 76. The increasing temperature can cause wraps 64, 88 to experience thermal growth with the higher growth occurring in the centers of scroll members 62, 76 and lesser growth occurring around the periphery. Thermal growth may vary from about 0.5 microns on the scroll periphery to about 10 microns in the zone adjacent to the scroll center, by way of non-limiting example. Thermal growth of the wraps occurs in the direction away from the respective base plate. For example, wrap 64 of orbiting scroll member 62 grows upwards (in the view depicted in FIG. 2) from upper surface 65, while wrap 88 of non-orbiting scroll member 76 grows downwards (in the view depicted in FIG. 2) from lower surface 86.

The concave deformations of upper surface 65 of orbiting scroll member 62 and lower surface 86 of non-orbiting scroll member 76, in conjunction with the thermal growth of wraps 64, 88, can result in the sealing between the tips of wraps 64, 88 and scroll members 76, 62 being reduced such that fluid leakage therebetween can occur. The quantity of fluid leakage can be affected by the physical properties of the working fluid being used and the pressure differences across those tips. The fluid leakage can affect the efficiency of compressor 20.

In accordance with the present teachings, fluid pressure in cavity 82 can be utilized to cause desirable bending or deformation of non-orbiting scroll member 76 to compensate for the undesirable deformation that can occur. The compensation can improve the sealing between the tips of wraps 64, 88 and the associated lower surface 86 of non-orbiting scroll member 76 and upper surface 65 of orbiting scroll member 62. According to the present teachings, this can be achieved by providing a high-pressure passageway 96 and a low-pressure passageway 98 that communicate with cavity 82 and extend through non-orbiting scroll member 76 to orbiting scroll member 62. Specifically, high-pressure passageway 96 can be disposed adjacent discharge passage 90 and can extend through non-orbiting scroll member 76 from cavity 82 through wrap 88 adjacent discharge passage 90. Low-pressure passageway 98 can extend through non-orbiting scroll member 76 from cavity 82 through wrap 88 adjacent the periphery of orbiting scroll member 62. High-pressure passageway 96 and low-pressure passageway 98 can allow the fluid being compressed by compressor 20 to flow between the compression cavities 92 and cavity 82 in response to deformation of scroll members 62, 76 and compensate for the undesirable deformation, as described below. By way of non-limiting example, the inner diameter of passageways 96, 98 can be about one millimeter.

Figure 3A:
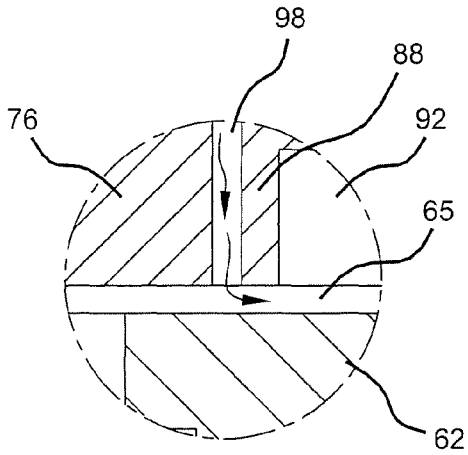
FIGS. 3A and 3B are enlarged exemplary fragmented views of the interaction of the fixed and orbiting scroll members within circle 3 of FIG. 2 in a non-sealed and sealed state according to the present teachings.
Figure 3B:
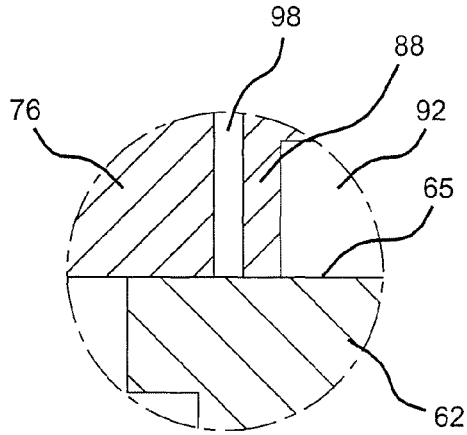
Figure 4A:
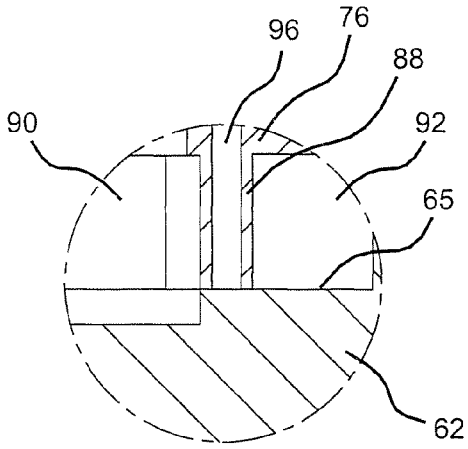
FIGS. 4A and 4B are enlarged exemplary fragmented views of the interaction of the fixed and orbiting scroll members within circle 4 of FIG. 2 in a sealed and non-sealed state according to the present teachings.
Figure 4B:
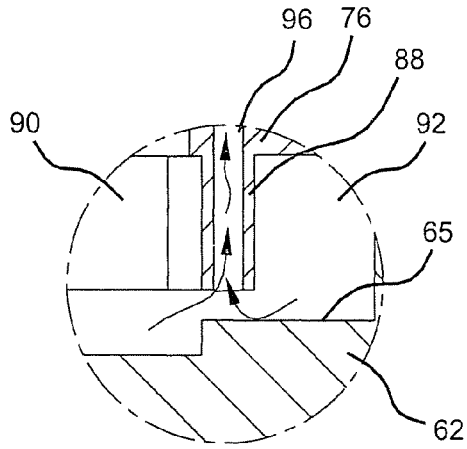
Figure 5:
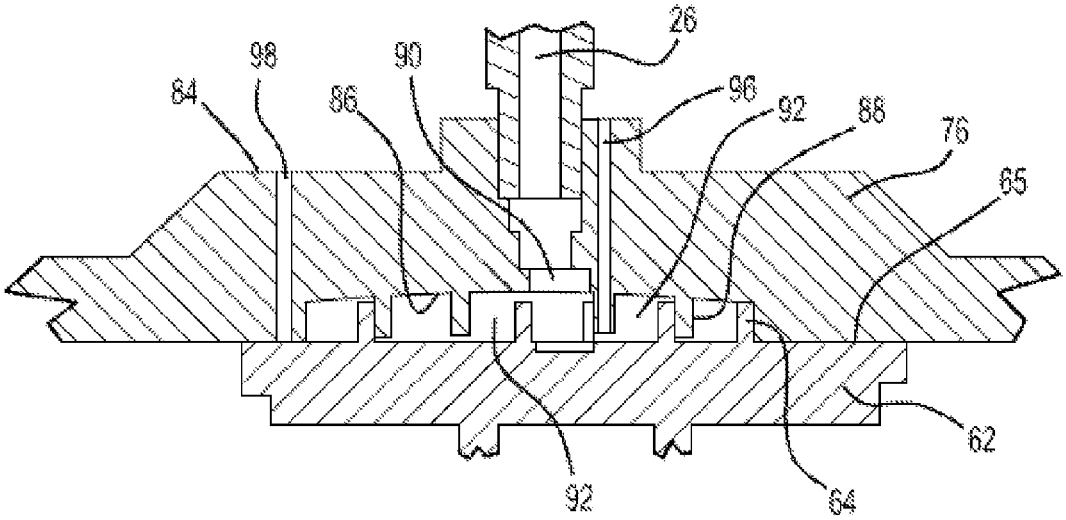
FIG. 5 is a partial cross-sectional view of the fixed and orbiting scroll members in a second position.
Figure 6:
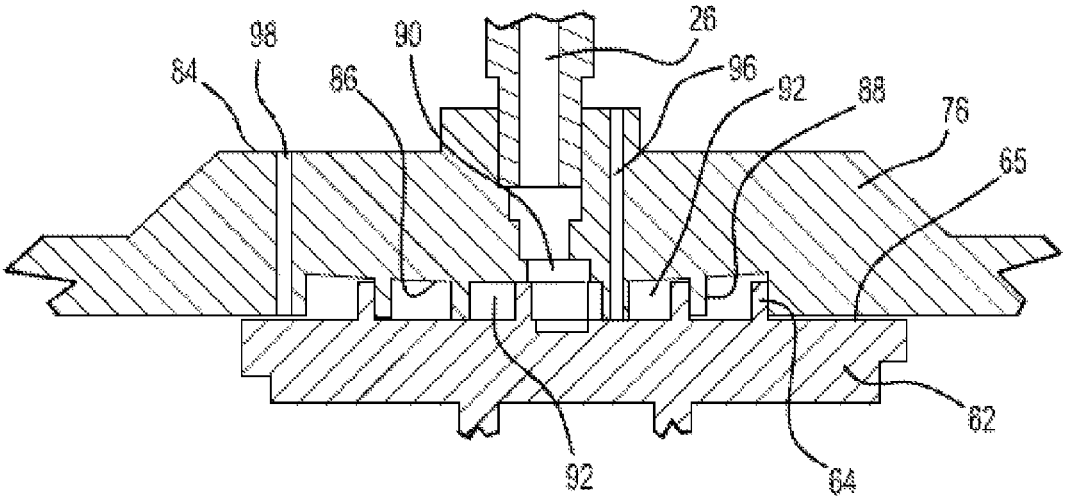
FIG. 6 is a partial cross-sectional view of the fixed and orbiting scroll members in a third position.

During initial operation of compressor 20, wherein scroll members 62, 76 are not deformed and thermal growth of wraps 64, 88 has not occurred, high and low-pressure passageways 96, 98 are sealed against the upper surface 65 of orbiting scroll member 62, as shown in FIGS. 3B and 4A. As operation of compressor 20 continues, the thermal growth of wraps 64, 88 and the deformation of orbiting and non-orbiting scroll members 62, 76 adjacent the centers thereof can result in high-pressure passageway 96 being no longer sealed against upper surface 65 of orbiting scroll member 62, as shown in FIG. 4B, while low-pressure passageway 98 remains sealed, as shown in FIG. 3B. As a result, high-pressure fluid in cavity 92 and discharge passage 90 adjacent wrap 88 containing high-pressure passageway 96 can travel through high-pressure passageway 96 and into cavity 82. The pressure in cavity 82 can increase up to a maximum of the discharge pressure of compressor 20 as fluid flows therein from high-pressure passageway 96. The increase in pressure in cavity 82 can cause the central portion of non-orbiting scroll member 76 to deform (downwardly in the views depicted) such that the wrap 88 through which high-pressure passageway 96 extends engages with upper surface 65 of orbiting scroll member 62, as shown in FIG. 4A, and seals high-pressure passageway 96.

The resulting deformation of the central part of non-orbiting scroll member 76 toward orbiting scroll member 62 can cause low-pressure passageway 98 to open, as shown in FIG. 3A, due to separation between wrap 88 associated with low-pressure passageway 98 and upper surface 65 of orbiting scroll member 62. As a result, high-pressure fluid in cavity 82 can leak through low-pressure passageway 98 and into the compression cavity 92 adjacent low-pressure passageway 98. As the pressure in cavity 82 continues to decrease as the fluid flows through low-pressure passageway 98, the deformation of the central part of non-orbiting scroll member 76 can decrease and eventually result in low-pressure passageway 98 being sealed by the tips of the associated wrap 88 engaging with upper surface 65 of orbiting scroll member 62, as shown in FIG. 3B. At that time, high-pressure passageway 96 may also still remain sealed, as shown in FIG. 4A or possibly re-open as shown in FIG. 4B.

As compressor 20 continues to operate, the high-pressure passageway 96, if not already re-opened, can again open due to separation between the wrap 88 associated with high-pressure passageway 96 disengaging from the upper surface 65 of orbiting scroll member 62 due to the fluid pressure therebetween and the thermal growth of wrap 88. As a result, fluid can flow from compression cavity 92 adjacent high-pressure passageway 96 and from discharge passage 90 into cavity 82 to again increase the pressure in cavity 82 and start the compensation cycle over again. The compensation cycle can continue to operate as compressor 20 is operated and the fluid being compressed therein causes axial deformation of the central parts of orbiting and non-orbiting scroll members 62, 76 and thermal growth of the associated wraps 64, 88. The pressure in cavity 82 will vary as high and low-pressure passageways 96, 98 are open and closed due to the compensation for the deformation. The cycling of the opening and closing of passageways 96, 98 can result in increased sealing between wraps 64, 88 such that an overall improvement in efficiency of compressor 20 is realized.

It should be appreciated that the stiffness of non-orbiting scroll member 76, as well as that of orbiting scroll member 62, can influence the amount of deformation that occurs during operation of compressor 20 and, accordingly, can be selected such that their deformation is within an operational envelope wherein proper compensation can be achieved by altering the pressure in cavity 82 through the use of high and low-pressure passageways 96, 98. The pressure in cavity 82 can vary from discharge pressure to suction pressure depending upon the location of high and low-pressure passageways 96, 98 and the operational gaps between orbiting and non-orbiting scroll members 62, 76 at these locations through which passageways 96, 98 communicate with the working fluid. Additionally, the location of axial supports for orbiting and non-orbiting scroll members 62, 76 can also affect the deformation that the scroll members incur. As such, the selection of the materials, dimensions, stiffness, location and quantity of supports, along with the number and size of high and low-pressure passageways 96, 98, can influence the ability of varying pressure in cavity 82 to compensate for deformations in orbiting and non-orbiting scroll members 62, 76.

Thus, a scroll compressor with scroll deflection compensation according to the present teachings can utilize high and low-pressure passageways 96, 98 that extend through non-orbiting scroll member 76 to allow fluid pressure in a cavity 82 that acts on the upper surface 84 of non-orbiting scroll member 76 to compensate for axial deformations and thermal growth of the associated wraps. The number, size, and location of high and low-pressure passageways 96, 98 can be chosen to provide a desired compensation. Additionally, the dimensions and stiffness of scroll members 62, 76 and the location of axial supports therefore can also be chosen to work in conjunction with high and low-pressure passageways 96, 98 to allow the pressure in cavity 82 to compensate for the deformation and thermal growth. As a result, increased sealing contact between the tips of wraps 88, 64 and the associated upper and lower surfaces 65, 86 of the respective orbiting scroll member 62 and non-orbiting scroll member 76 can be improved thereby improving the overall efficiency of compressor 20.

While the present teachings are shown in exemplary fashion by referring to the compressor illustrated in the figures, it should be appreciated that compressor 20 can take various forms and still be within the scope of the present teachings. Additionally, it should also be appreciated that the dimensions shown herein are for exemplary purposes only and may not reflect actual dimensions, relative or absolute, and, in some cases, may be exaggerated. Moreover, the location, number, and size of passageways 96, 98 are merely exemplary and changes in the location, size, and number can be employed without departing from the spirit and scope of the present teachings. It should be appreciated that it may be possible to include high and low pressure passageways that extend through orbiting scroll member 62 and communicate with a sealed cavity to allow orbiting scroll member 62 to compensate for the undesirable deformation. Additionally, it should be appreciated that the directional indicators (e.g., upward, downward) used herein refer to the orientations of the components depicted in the drawings and a re not absolute directional indicators. Thus, it should be appreciated that changes in the configurations shown can be employed without deviating from the spirit and scope of the present teachings. Such variations are not to be regarded as a departure from the spirit and scope of the claims.

What is claimed is:

1. A compressor comprising:

a chamber;

a first scroll member including a first end plate, a first wrap extending from said first end plate, a discharge passage and first and second auxiliary passages, said first and second auxiliary passages being in communication with said chamber, said first auxiliary passage being located radially inward relative to said second auxiliary passage; and a second scroll member including a second end plate, a second wrap extending from said second end plate and meshingly engaged with said first wrap to form compression pockets, one of said first and second scroll members being displaceable from a first position to a second position during compressor operation, the second position including a central portion of said one of said first and second scroll members being displaced axially outward from the other of said first and second scroll members relative to the first position to provide communication between said first auxiliary passage and a first of said compression pockets.

2. The compressor of claim 1, wherein said first compression pocket includes a compression pocket immediately adjacent said discharge passage.

3. The compressor of claim 1, wherein said first auxiliary passage is isolated from communication with said first compression pocket in the first position.

4. The compressor of claim 1, wherein said one of said first and second scroll members is said first scroll member.

5. The compressor of claim 4, wherein said first scroll member is displaceable to a third position where said central portion of said first scroll member is displaced axially inward toward said second scroll member relative to the first and second positions to provide communication between said second auxiliary passage and a suction pressure region of the compressor.

6. The compressor of claim 5, wherein said second auxiliary passage is isolated from communication with said suction pressure region during the second position.

7. The compressor of claim 6, wherein said second auxiliary passage is isolated from communication with said suction pressure region during the first position.

8. The compressor of claim 5, wherein said first end plate has a generally convex shape in the third position.

9. The compressor of claim 1, wherein said axially outward displacement includes said central portion of said one of said first and second scroll members being displaced axially outwardly relative to a radially outer portion thereof.

10. The compressor of claim 1, wherein displacement from said first position to said second position is generated by a pressure within said compression pockets.

11. The compressor of claim 1, wherein displacement from said first position to said second position is generated by a thermal expansion of one of said first and second wraps.

12. The compressor of claim 1, wherein one of said first and second end plates associated with said one of said first and second scroll members has a generally concave shape in the second position.

13. The compressor of claim 1, wherein said first auxiliary passage extends through said first wrap.

14. The compressor of claim 1, wherein said first auxiliary passage is constantly in communication with said first compression pocket during the second position.

15. The compressor of claim 1, wherein said first auxiliary passage is in communication with said second end plate during the first position.

16. The compressor of claim 1, wherein said second auxiliary passage is in communication with said second end plate during the first position.

17. The compressor of claim 1, wherein said first scroll member includes a non-orbiting scroll member.

18. The compressor of claim 1, further comprising a shell containing said chamber and said first and second scroll members.

19. The compressor of claim 18, further comprising a bearing housing fixed to said shell, said first scroll member being connected to said bearing housing.

20. The compressor of claim 1, wherein said chamber is partially defined by an axial end surface of said first scroll member generally opposite said first wrap.

* * * * *